US009023191B2

(12) United States Patent
Teshima et al.

(10) Patent No.: US 9,023,191 B2
(45) **Date of Patent: *May 5, 2015**

(54) LUBRICANT COMPOSITION FOR AN INTERNAL COMBUSTION ENGINE AND METHOD FOR LUBRICATING AN INTERNAL COMBUSTION ENGINE

(75) Inventors: Kazuhiro Teshima, Ichihara (JP); Motoharu Ishikawa, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 32 days.

This patent is subject to a terminal disclaimer.

(21) Appl. No.: 13/639,048

(22) PCT Filed: Mar. 31, 2011

(86) PCT No.: PCT/JP2011/058292

§ 371 (c)(1),
(2), (4) Date: Oct. 2, 2012

(87) PCT Pub. No.: WO2011/125880

PCT Pub. Date: Oct. 13, 2011

(65) Prior Publication Data

US 2013/0023705 A1 Jan. 24, 2013

(30) Foreign Application Priority Data

Apr. 2, 2010 (JP) ..... 2010-086582

(51) Int. Cl.

| | |
|---|---|
| ***C10M 171/04*** | (2006.01) |
| ***C10M 171/02*** | (2006.01) |
| ***C10M 171/00*** | (2006.01) |
| ***C10M 111/04*** | (2006.01) |

(52) U.S. Cl.

CPC ..... *C10M 111/04* (2013.01); *C10M 2203/1025* (2013.01); *C10M 2209/084* (2013.01); *C10N 2220/022* (2013.01); *C10N 2230/02* (2013.01); *C10N 2230/54* (2013.01); *C10N 2230/74* (2013.01); *C10N 2240/10* (2013.01); *C10M 2203/1006* (2013.01); *C10M 2205/0285* (2013.01); *C10N 2230/08* (2013.01); *C10N 2270/00* (2013.01)

USPC ..... 208/19; 208/18; 585/1; 585/10; 585/12; 585/13

(58) Field of Classification Search

CPC ..... C10M 1/00; C10M 1/08; C10M 101/00; C10M 107/00; C10M 107/114; C10M 107/08; C10M 111/00; C10M 111/02; C10M 111/04; C10M 143/00; C10M 143/06; C10M 169/00; C10M 169/005; C10M 171/00; C10M 171/02; C10M 2205/00; C10M 2205/003; C10M 2205/026; C10M 2205/0265

USPC ..... 208/18, 19; 585/1, 10, 13, 12

See application file for complete search history.

(56) References Cited

U.S. PATENT DOCUMENTS

| | | | |
|---|---|---|---|
| 4,370,246 A | 1/1983 | DeVries et al. | |
| 5,858,932 A | 1/1999 | Dasai et al. | |
| 2006/0211581 A1* | 9/2006 | Bullock et al. | 508/110 |
| 2008/0234153 A1 | 9/2008 | Matsui | |
| 2011/0039743 A1 | 2/2011 | Bagheri et al. | |

FOREIGN PATENT DOCUMENTS

| | | |
|---|---|---|
| JP | 62 240385 | 10/1987 |
| JP | 3 22438 | 3/1991 |
| JP | 10 114895 | 5/1998 |
| JP | 10 330778 | 12/1998 |
| JP | 2003 252887 | 9/2003 |
| JP | 2004 2866 | 1/2004 |
| JP | 2007-137952 A | 6/2007 |
| JP | 2008-184569 A | 8/2008 |
| JP | 2008 533274 | 8/2008 |
| JP | 2008 231189 | 10/2008 |
| JP | 2008 231190 | 10/2008 |
| JP | 2008 231191 | 10/2008 |
| JP | 2008 231192 | 10/2008 |
| JP | 2009 510214 | 3/2009 |
| JP | 2009-227943 A | 10/2009 |
| JP | 2010-31082 A | 2/2010 |
| JP | 5185489 B2 | 1/2013 |
| WO | 2007-114260 A1 | 10/2007 |
| WO | WO 2009/073135 A1 | 6/2009 |

OTHER PUBLICATIONS

SK Yubase MSDS 4 (2013).*
Group IV Base Stocks PAO Exxon Mobil Sep. 2011.*
SK Yubase MSDS 4 (2013.*
SK Yubase MSDS 6 (2013).*
U.S. Appl. No. 13/639,035, filed Oct. 2, 2012, Teshima, et al.
U.S. Appl. No. 13/638,997, filed Oct. 2, 2012, Teshima, et al.
International Search Report Issued Jun. 7, 2011 in PCT/JP11/58292 Filed Mar. 31, 2011.
Extended European Search Report issued Sep. 10, 2013 in Patent Application No. 11765780.9.
"Durasyn ® 145 Polyalphaolefins", Material Safety Data Sheet, http://www.3eonline.com/ImageServer/NewPdf/1915fa5c98f54dd299ab2ac018d2eale.pdf, XP055076930, May 20, 2009, 5 pages.
Shubkin et al., "Olefin Oligomer Synthetic Lubricants: Structure and Mechanism of Formation", Ind. Eng. Chem. Prod. Res. Dev. 1980, 19, pp. 15-19.
Kim et al., Higher α—Olefin Polymerizations Catalyzed by *rac*-$Me_2Si(1\text{-}C_5H_2\text{-}2\text{-}CH_3\text{-}4\text{-}^1Bu)_2Zr(NMe_2)_2/Al(iBu)_3/[Ph_3C][B(C_6F_5)_4]$, Journal of Polymer Science, Part A: Polymer Chemistry, vol. 38, pp. 1687-1697).
Office Action dated Mar. 17, 2015 issued in corresponding Japanese patent application No. 2012-50596.
Office Action dated Mar. 17, 2015 issued in corresponding Japanese patent application No. 2012-509595.

* cited by examiner

*Primary Examiner* — Pamela H Weiss
(74) *Attorney, Agent, or Firm* — Oblon, McClelland, Maier & Neustadt, L.L.P.

(57) ABSTRACT

A lubricating oil composition for an internal combustion engine contains a component (A) of a polyalphaolefin having a kinematic viscosity at 100 degrees C. of 5.5 $mm^2/s$ or less, a CCS viscosity at −35 degrees C. of 3000 mPA·s or less and a NOACK of 12 mass % or less, and a component (B) of a mineral oil having a viscosity index of 120 or more. The component (A) is contained at a content of 10 mass % or more of a total amount of the composition.

10 Claims, No Drawings

LUBRICANT COMPOSITION FOR AN INTERNAL COMBUSTION ENGINE AND METHOD FOR LUBRICATING AN INTERNAL COMBUSTION ENGINE

TECHNICAL FIELD

The present invention relates to a lubricating oil composition for an internal combustion engine.

BACKGROUND ART

In an internal combustion engine such as a gasoline engine and a diesel engine, carbon deposits called caulking may be formed inside the engine during use. Generation of caulking causes an insufficient cooling inside the engine or blocks a flow of the lubricating oil, which may bring various damages. Particularly in the engine provided with a turbo mechanism, caulking generated in a turbo bearing, a housing or an oil supply path is a problem.

In order to prevent generation of caulking, use of a lubricating oil having a low vaporizability is effective. As the lubricating oil having a low vaporizability for the internal combustion engine, a composition including a blend of a base oil of Group II or Group III in the API classification and a low viscous PAO has been proposed (see Patent Literatures 1 and 2).

CITATION LIST

Patent Literature(s)

Patent Literature 1 JP-T-2008-533274
Patent Literature 2 JP-T-2009-510214

SUMMARY OF THE INVENTION

Problems to be Solved by the Invention

On the other hand, fuel-saving performance is also an important factor in the lubricating oil for the internal combustion engine. However, since the lubricating oil having a low vaporizability generally exhibits a high viscosity, fuel-saving performance may be deteriorated. The lubricating oil compositions disclosed in Patent Literatures 1 and 2 are not necessarily sufficient in a balance of a low vaporizability and fuel-saving performance.

An object of the invention is to provide a lubricating oil composition for an internal combustion engine which exhibits a low vaporizability and an excellent fuel-saving performance.

Means for Solving the Problems

In order to solve the above-mentioned problems, according to an aspect of the invention, lubricating oil compositions for an internal combustion engine as follows are provided.

(1) According to an aspect of the invention, a lubricating oil composition for an internal combustion engine contains a component (A) of a polyalphaolefin having a kinematic viscosity at 100 degrees C. of 5.5 $mm^2/s$ or less, a CCS viscosity at −35 degrees C. of 3000 mPa·s or less and a NOACK of 12 mass % or less, and a component (B) of a mineral oil having a viscosity index of 120 or more, the component (A) being contained at a content of 10 mass % or more of a total amount of the composition.

(2) In the above aspect of the invention, a kinematic viscosity at 100 degrees C. of a mixed base oil provided by blending the components (A) and (B) is 4.35 $mm^2/s$ or less.

(3) In the above aspect of the invention, the NOACK of the composition is 13 mass % or less and the CCS viscosity at −35 degrees C. is 5500 mPa·s or less.

(4) In the above aspect of the invention, the component (B) is contained at a content of 50 mass % or more of the total amount of the composition.

(5) In the above aspect of the invention, the component (A) is provided by polymerization with a metallocene catalyst.

(6) In the above aspect of the invention, the component (A) is a polyalphaolefin formed by at least one of alpha-olefins having 10 to 14 carbon atoms as a monomer unit.

(7) In the above aspect of the invention, the component (A) is a trimer.

Advantage(s) of the Invention

Since the lubricating oil composition for the internal combustion engine according to the above aspect of the invention contains a PAO having specific properties and a mineral oil having specific properties, the lubricating oil composition exhibits a low vaporizability and an excellent fuel-saving performance. Accordingly, the composition according to the above aspect of the invention is suitable to a gasoline engine and a diesel engine.

DESCRIPTION OF EMBODIMENT(S)

In an exemplary embodiment of the invention, a lubricating oil composition for an internal combustion engine contains a component (A) of a polyalphaolefin having a kinematic viscosity at 100 degrees C. of 5.5 $mm^2/s$ or less, a CCS viscosity at −35 degrees C. of 3000 mPa·s or less and a NOACK of 12 mass % or less, and a component (B) of a mineral oil having a viscosity index of 120 or more. The lubricating oil composition will be described in detail below.

Component (A)

The component (A) in this exemplary embodiment is a polyalphaolefin (PAO) in a form of a polymer (oligomer) of alpha-olefins.

In terms of fuel-saving performance, the kinematic viscosity at 100 degrees C. of the PAO (i.e., the component (A)) is required to be 5.5 $mm^2/s$ or less. However, in terms of lubricity, the kinematic viscosity at 100 degrees C. thereof is preferably 3 $mm^2/s$ or more. The CCS viscosity at −35 degrees C. is required to be 3000 mPa·s or less. Moreover, in terms of a low vaporizability, the NOACK is also required to be 12 mass % or less.

The number of carbon atoms of an alpha-olefin (i.e., a monomer unit) for such a PAO is preferably from 6 to 20 in terms of a viscosity index, a pour point, low temperature properties (e.g., a low-temperature viscosity) and vaporizability, more preferably from 8 to 16, particularly preferably 10 to 14. The PAO is preferably a trimer of alpha-olefins in terms of a low vaporizability, caulking resistance and a low fuel-saving performance. In order to provide the PAO with such intended properties, the number of carbon atoms, a blend ratio and a polymerization degree of the alpha-olefins are adjustable.

As a polymerization catalyst for the alpha-olefins, a $BF_3$ catalyst, an $AlCl_3$ catalyst, a Ziegler-type catalyst and a metallocene catalyst are usable. Typically, the $BF_3$ catalyst has been used for a low viscous PAO having a kinematic viscosity at 100 degrees C. of less than 30 $mm^2/s$ while the $AlCl_3$ catalyst has been used for a low viscous PAO having a kinematic viscosity at 100 degrees C. of 30 $mm^2/s$ or more. In terms of a low vaporizability, caulking resistance and a low fuel-saving performance, the $BF_3$ catalyst and the metallocene catalyst are particularly preferable.

The $BF_3$ catalyst is used along with a promoter such as water, alcohol and esters, among which alcohol, especially 1-butanol, is preferable in terms of the viscosity index, the low temperature properties and a yield.

The metallocene catalyst is exemplified by a catalyst including a combination of a metallocene compound and a promoter. The metallocene compound is preferably a metallocene compound represented by the following formula (1).

$$(RC_5H_4)_2MX_2 \quad (1)$$

In the formula (1), R is a hydrogen atom or a hydrocarbon group having 1 to 10 carbon atoms, M is a transition metal element in Group 4 of the periodic table, and X is a covalent ligand or an ion binding ligand.

In the formula (1), R is preferably a hydrogen atom or a hydrocarbon group having 1 to 4 carbon atoms. Specific examples of M include titanium, zirconium and hafnium, among which zirconium is preferable. Specific examples of X include a hydrogen atom, a halogen atom, a hydrocarbon group having 1 to 20 carbon atoms (preferably 1 to 10 carbon atoms), an alkoxy group having 1 to 20 carbon atoms (preferably 1 to 10 carbon atoms), an amino group, a phosphorus-containing hydrocarbon group having 1 to 20 carbon atoms (preferably 1 to 12 carbon atoms) (e.g., a diphenyl phosphine group), a silicon-containing hydrocarbon group having 1 to 20 carbon atoms (preferably 1 to 12 carbon atoms) (e.g., a trimethylsilyl group), and a boron compound containing a hydrocarbon group having 1 to 20 carbon atoms (preferably 1 to 12 carbon atoms) or halogen (e.g., $B(C_6H_5)_4$ and $BF_4$), among which a group selected from the group consisting of a hydrogen atom, a halogen atom, a hydrocarbon group and an alkoxy group is preferable.

Examples of the metallocene compound represented by the formula (1) include bis(cyclopentadienyl)zirconium dichloride, bis(methylcyclopentadienyl)zirconium dichloride, bis(ethylcyclopentadienyl)zirconium dichloride, bis(iso-propylcyclopentadienyl)zirconium dichloride, bis(n-propylcyclopentadienyl)zirconium dichloride, bis(n-butylcyclopentadienyl)zirconium dichloride, bis(t-butylcyclopentadienyl)zirconium dichloride, bis(thexylcyclopentadienyl)zirconium dichloride, bis(trimethylsilylcyclopentadienyl)zirconium dichloride, bis(trimethylsilylmethylcyclopentadienyl)zirconium dichloride, bis(cyclopentadienyl)zirconium chlorohydride, bis(cyclopentadienyl)methyl zirconium chloride, bis(cyclopentadienyl)ethyl zirconium chloride, bis(cyclopentadienyl)methoxy zirconium chloride, bis(cyclopentadienyl)phenyl zirconium chloride, bis(cyclopentadienyl)dimethyl zirconium, bis(cyclopentadienyl)diphenyl zirconium, bis(cyclopentadienyl)dineopentyl zirconium, bis(cyclopentadienyl)dihydro zirconium, bis(cyclopentadienyl)dimethoxy zirconium, a compound obtained by substituting a chlorine atom with a bromine atom, a iodine atom, a hydrogen atom, a methyl group, a phenyl group or the like in the above compounds, and a compound obtained by substituting zirconium (central metal) with titanium or hafnium in the above compounds.

The promoter is preferably methylaluminoxane. Methylaluminoxane is subject to no specific limitation. Known methylaluminoxane is usable, examples of which include a linear methylaluminoxane represented by the following formula (2) and a cyclic methylaluminoxane represented by the following formula (3).

[Formula 1]

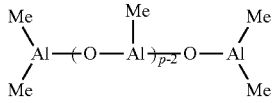

(2)

[Formula 2]

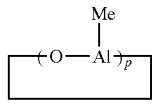

(3)

In the formulae (2) and (3), p represents a polymerization degree of typically 3 to 50, preferably 7 to 40.

A manufacturing method of methylaluminoxane is exemplified by a method of contacting methyl aluminium with a condensation agent (e.g., water), but the manufacturing method is subject to no specific limitation and methylaluminoxane may be manufactured by reaction according to any known method.

A blend ratio between the metallocene compound and methylaluminoxane (methylaluminoxane/the metallocene compound (a molar ratio)) is typically from 15 to 150, preferably from 20 to 120, more preferably from 25 to 100. At the blend ratio of 15 or more, a catalyst activity is expressed and a yield of a trimer or a multimer suitable for a lubricating base oil is not decreased since a dimer of alpha-olefins are formed. On the other hand, at the blend ratio of 150 or less, incomplete removal of the catalyst is avoided.

Other than the above metallocene catalyst, the metallocene catalyst is exemplified by a metallocene catalyst using a metallocene compound having a crosslinking group. Such a metallocene compound is preferably a metallocene compound having two crosslinking groups, particularly preferably a metallocene compound having meso-symmetry. The metallocene catalyst using the metallocene compound having meso-symmetry is exemplified by a metallocene catalyst containing: a catalyst component (a) of a metallocene compound represented by the following formula (4); and a catalyst component (b) containing a catalyst component (b-1) of a compound capable of forming an ionic complex by reacting with the metallocene compound of the component (a) or derivatives thereof, and a catalyst component (b-2) of at least one of aluminoxanes.

[Formula 3]

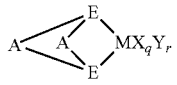

(4)

The compound represented by the formula (4) has meso-symmetry. In the formula (4), M represents a metal atom in Group 3 to Group 10 of the periodic table. X represents a a bonding ligand. When a plurality of X exist, the plurality of X may be the same or different. Y represents a Lewis base. When a plurality of Y exist, the plurality of Y may be the same or different. A represents a crosslinking group selected from a hydrocarbon group having 1 to 20 carbon atoms, a halogen-containing hydrocarbon group having 1 to 20 carbon atoms, a silicon-containing group, a germanium-containing group, a stannum-containing group, —O—, —CO—, —S—, —$SO_2$—, —Se—, —$NR^1$—, —P(O)$R^1$—, —$BR^1$— and —Al$R^1$—. Two A may be the same or different. $R^1$ represents a hydrogen atom, a halogen atom, a hydrocarbon group having 1 to 20 carbon atoms or a halogen-containing hydrocarbon group having 1 to 20 carbon atoms. q is an integer of 1 to 5 representing [(a valence of M)−2]. r is an integer of 0 to 3. E represents a group represented by the following formulae (5) and (6). Two E are the same.

It should be noted that the compound having meso-symmetry means a transitional metal compound that crosslinks the two E with two crosslinking groups in a bonding patterns (1,1') and (2,2').

[Formula 4]

(5)

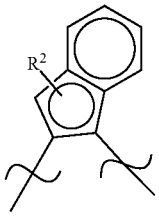

[Formula 5]

(6)

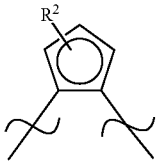

In the formulae (5) and (6), $R^2$ represents a group selected from the group consisting of a hydrogen atom, a halogen atom, a hydrocarbon group having 1 to 20 carbon atoms, a halogen-containing hydrocarbon group having 1 to 4 carbon atoms, a silicon-containing group and a hetero-atom-containing group. When a plurality of $R^2$ exist, the plurality of $R^2$ may be the same or different. A bond shown in a wavy line represents a bond to the crosslinking group A.

The crosslinking group A in the formula (4) is preferably a group represented by the following formula (7).

[Formula 6]

(7)

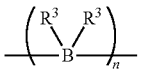

In the formula (7), B is a skeleton of the crosslinking group and represents a carbon atom, a silicon atom, a boron atom, a nitrogen atom, a germanium atom, a phosphorus atom or an aluminium atom. $R^3$ represents a hydrogen atom, a carbon atom, an oxygen atom, an aliphatic hydrocarbon group, an aromatic hydrocarbon group, an amine-containing group or a halogen-containing group. n is 1 or 2.

Examples of the metallocene compound represented by the formula (4) include (1,1'-ethylene)(2,2'-ethylene)-bis(indenyl)zirconium dichloride, (1,1'-methylene)(2,2'-methylene)-bis(indenyl)zirconium dichloride, (1,1'-isopropylidene)(2,2'-isopropylidene)-bis(indenyl)zirconium dichloride, (1,1'-ethylene)(2,2'-ethylene)-bis(3-methylindenyl)zirconium dichloride, (1,1'-ethylene)(2,2'-ethylene)-bis(4,5-benzoindenyl)zirconium dichloride, (1,1'-ethylene)(2,2'-ethylene)-bis(4-isopropylindenyl)zirconium dichloride, (1,1'-ethylene)(2,2'-ethylene)-bis(5,6-dimethylindenyl)zirconium dichloride, (1,1'-ethylene)(2,2'-ethylene)-bis(4,7-diisopropylindenyl) zirconium dichloride, (1,1'-ethylene)(2,2'-ethylene)-bis(4-phenylindenyl)zirconium dichloride, (1,1'-ethylene)(2,2'-ethylene)-bis(3-methyl-4-isopropylindenyl)zirconium dichloride, (1,1'-ethylene)(2,2'-ethylene)-bis(5,6-benzoindenyl)zirconium dichloride, (1,1'-dimethylsilylene)(2,2'-dimethylsilylene)-bis(cyclopentadienyl)zirconium dichloride, (1,1'-dimethylsilylene)(2,2'-dimethylsilylene)-bis(indenyl) zirconium dichloride, (1,1'-dimethylsilylene)(2,2'-dimethylsilylene)-bis(3-methylindenyl)zirconium dichloride, (1,1'-dimethylsilylene)(2,2'-dimethylsilylene)-bis(3-n-butylindenyl)zirconium dichloride, (1,1'-dimethylsilylene)(2,2'-dimethyl silylene)-bis(3-i-propylindenyl)zirconium dichloride, (1,1'-dimethylsilylene)(2,2'-dimethylsilylene)-bis(3-trimethylsilylmethylindenyl)zirconium dichloride, (1,1'-dimethylsilylene)(2,2'-dimethylsilylene)-bis(3-phenylindenyl)zirconium dichloride, (1,1'-dimethyl silylene)(2,2'-dimethylsilylene)-bis(4,5-benzoindenyl)zirconium dichloride, (1,1'-dimethyl silylene)(2,2'-dimethylsilylene)-bis(4-isopropylindenyl)zirconium dichloride, (1,1'-dimethyl silylene)(2,2'-dimethyl silylene)-bis(5,6-dimethylindenyl) zirconium dichloride, (1,1'-dimethylsilylene)(2,2'-dimethylsilylene)-bis(4,7-di-i-propylindenyl)zirconium dichloride, (1,1'-dimethylsilylene)(2,2'-dimethylsilylene)-bis(4-phenylindenyl)zirconium dichloride, (1,1'-dimethylsilylene)(2,2'-dimethylsilylene)-bis(3-methyl-4-i-propylindenyl)zirconium dichloride, (1,1'-dimethylsilylene)(2,2'-dimethylsilylene)-bis(5,6-benzoindenyl)zirconium dichloride, and a compound obtained by substituting zirconium of the above compounds with titanium or hafnium. The metallocene compound is not limited to the above compounds.

As the catalyst component (b-1) of the catalyst component (b), any compounds are usable as long as the compounds can form an ionic complex by reacting with the metallocene compound of the catalyst component (a). A compound represented by the following formula (8) or (9) is preferably usable.

$$([L^1\text{-}R^4]^{k+})_a([Z]^-)_b \quad (8)$$

$$([L^2]^{k+})_a([Z]^-)_b \quad (9)$$

In the formulae (8) and (9), $L^1$ represents a Lewis base and $L^2$ represents $M^2$, $R^5R^6M^3$, $R^7{}_3C$ or $R^8M^3$. $[Z]^-$ represents a non-coordinating anion $[Z^1]^-$ or $[Z^2]^-$. Herein, $[Z^1]^-$ represents an anion in which a plurality of groups are bonded to an element, namely, $[M^1G^1G^2 \ldots G^f]^-$ (in which $M^1$ represents an element in Group 5 to Group 15 of the periodic table, preferably an element in Group 13 to Group 15. $G^1$ to $G^f$ each represent a hydrogen atom, a halogen atom, an alkyl group having 1 to 20 carbon atoms, a dialkylamino group having 2 to 40 carbon atoms, an alkoxy group having 1 to 20 carbon atoms, an aryl group having 6 to 20 carbon atoms, an aryloxy group having 6 to 20 carbon atoms, an alkyl aryl group having 7 to 40 carbon atoms, an aryl alkyl group having 7 to 40 carbon atoms, a halogen-substituted hydrocarbon group having 1 to 20 carbon atoms, an acyloxy group having 1 to 20 carbon atoms, an organic metalloid group or a hetero-atom-containing hydrocarbon group having 2 to 20 carbon atoms. Two or more of $G^1$ to $G^f$ may form a ring. f represents an integer of [(a valence of the central metal $M^1$)+1].) $[Z^2]^-$ represents a Brønsted acid alone in which a logarithm (pKa) of a reciprocal number of an acid dissociation constant is −10 or less, a conjugate base of a combination of the Brønsted acid and a Lewis acid, or a conjugate base of an acid defined as a superstrong acid. Moreover, the Lewis base may be coordinated. $R^4$ represents a hydrogen atom, an alkyl group having 1 to 20 carbon atoms, an aryl group, an alkyl aryl group or an aryl alkyl group having 6 to 20 carbon atoms. $R^5$ and $R^6$ each represent a cyclopentadienyl group, a substituted cyclopentadienyl group, an indenyl group or a fluorenyl group. $R^7$ represents an alkyl group, an aryl group, an alkyl aryl group or an aryl alkyl group having 1 to 20 carbon atoms. $R^8$ represents a macrocyclic ligand such as tetraphenylporphyrin and phthalocyanine k is an integer of 1 to 3 representing an ionic valence of $[L^1\text{-}R^4]$ and $[L^2]$. a is an integer of 1 or more and b=(k×a) $M^2$ represents an element in Group 1 to Group 3, Group 11 to Group 13, and Group 17 of the periodic table. $M^3$ represents an element in Group 7 to Group 12.

Specific examples of $L^1$ include: amines such as ammonia, methylamine, aniline, dimethylamine, diethylamine, N-methylaniline, diphenylamine, N,N-dimethylaniline, trimethylamine, triethylamine, tri-n-butylamine, methyldiphenylamine, pyridine, p-bromo-N,N-dimethylaniline and p-nitro-N,N-dimethylaniline; phosphines such as triethylphosphine, triphenylphosphine and diphenylphosphine; thioethers such as tetrahydrothiophene; esters such as ethyl benzoate; and nitriles such as acetonitrile and benzonitrile.

Specific examples of $R^4$ include hydrogen, a methyl group, an ethyl group, a benzyl group and a trityl group. Specific examples of $R^5$ and $R^6$ include a cyclopentadienyl group, a methyl cyclopentadienyl group, an ethyl cyclopentadienyl group and a pentamethyl cyclopentadienyl group. Specific examples of $R^7$ include a phenyl group, a p-tolyl group and a p-methoxyphenyl group. Specific examples of $R^8$ include tetraphenylporphyrin, phthalocyanine, allyl and methallyl. Specific examples of $M^2$ include $L^1$, Na, K, Ag, Cu, Br and I. Specific examples of $M^3$ include Mn, Fe, Co, Ni and Zn. In $[Z^1]^-$, namely, $[M^1G^1G^2 \ldots G^f]^-$, specific examples of $M^1$ include B, Al, Si, P, As and Sb, among which B and Al are preferable. Specific examples of $G^1$ and $G^2$ to $G^f$ include: a dialkylamino group such as a dimethylamino group and a diethylamino group; an alkoxy group or aryloxy group such as a methoxy group, an ethoxy group, an n-butoxy group and a phenoxy group; a hydrocarbon group such as a methyl group, an ethyl group, an n-propyl group, an isopropyl group, an n-butyl group, an isobutyl group, an n-octyl group, an n-eicosyl group, a phenyl group, a p-tolyl group, a benzyl group, a 4-t-butylphenyl group and a 3,5-dimethylphenyl group; a halogen atom such as fluorine, chlorine, bromine and iodine; a hetero-atom-containing hydrocarbon group such as a p-fluorophenyl group, a 3,5-difluorophenyl group, a pentachlorophenyl group, a 3,4,5-trifluorophenyl group, a pentafluorophenyl group, a 3,5-bis(trifluoromethyl)phenyl group and a bis(trimethylsilyl)methyl group; an organic metalloid group such as a pentamethyl antimony group, a trimethylsilyl group, a trimethyl germyl group, a diphenyl arsine group, a dicyclohexyl antimony group and diphenyl boron.

Specific examples of the non-coordinating anion $[Z^2]^-$, namely, the Brønsted acid alone having pKa of −10 or less or the conjugate base of a combination of the Brønsted acid and a Lewis acid include a trifluoromethanesulfonate anion $(CF_3SO_3)^-$, a bis(trifluoromethanesulfonyl)methyl anion, a bis(trifluoromethanesulfonyl)benzyl anion, bis(trifluoromethanesulfonyl)amide, a perchloric acid anion $(ClO_4)^-$, a trifluoroacetate anion $(CF_3CO_2)^-$, a hexafluoroantimony anion $(SbF_6)^-$, a fluorosulfonic acid anion $(FSO_3)^-$, a chlorosulfonic acid anion $(ClSO_3)^-$, a fluorosulfonic acid anion/antimony pentafluoride $(FSO_3/SbF_5)^-$, a fluorosulfonic acid anion/arsenic pentafluoride $(FSO_3/AsF_5)^-$ and a trifluoromethanesulfonate/antimony pentafluoride $(CF_3SO_3/SbF_5)^-$.

Specific examples of the ionic compound (i.e., the catalyst component (b-1)) for forming an ionic complex by reacting with the transitional metal compound of the catalyst component (a) include N,N-dimethyl anilinium tetrakis(pentafluorophenylborate), triethylammonium tetraphenylborate, tri-n-butyl ammonium tetraphenylborate, trimethyl ammonium tetraphenylborate, tetraethyl ammonium tetraphenylborate, methyl(tri-n-butyl)ammonium tetraphenylborate, benzyl(tri-n-butyl)ammonium tetraphenylborate, dimethyldiphenyl ammonium tetraphenylborate, triphenyl(methyl)ammonium tetraphenylborate, trimethyl anilinium tetraphenylborate, methylpyridinium tetraphenylborate, benzylpyridinium tetraphenylborate, methyl(2-cyanopyridinium)tetraphenylborate, triethyl ammonium tetrakis(pentafluorophenyl)borate, tri-n-butyl ammonium tetrakis(pentafluorophenyl)borate, triphenyl ammonium tetrakis(pentafluorophenyl)borate, tetra-n-butyl ammonium tetrakis(pentafluorophenyl)borate, tetraethyl ammonium tetrakis(pentafluorophenyl)borate, benzyl(tri-n-butyl)ammonium tetrakis(pentafluorophenyl) borate, methyldiphenyl ammonium tetrakis(pentafluorophenyl)borate, triphenyl(methyl)ammonium tetrakis(pentafluorophenyl)borate, methyl anilinium tetrakis (pentafluorophenyl)borate, dimethyl anilinium tetrakis (pentafluorophenyl)borate, trimethyl anilinium tetrakis (pentafluorophenyl)borate, methylpyridinium tetrakis (pentafluorophenyl)borate, benzyl pyridinium tetrakis (pentafluorophenyl)borate, methyl(2-cyanopyridinium) tetrakis(pentafluorophenyl)borate, benzyl(2-cyanopyridinium)tetrakis(pentafluorophenyl)borate, methyl (4-cyanopyridinium)tetrakis(pentafluorophenyl)borate, triphenyl phosphonium tetrakis(pentafluorophenyl)borate, dimethyl anilinium tetrakis [bis(3,5-ditrifluoromethyl)phenyl]borate, ferrocenium tetraphenylborate, silver tetraphenylborate, trityl tetraphenylborate, tetraphenyl porphyrin manganese tetraphenylborate, ferrocenium tetrakis(pentafluorophenyl)borate, (1,1'-dimethyl ferrocenium)tetrakis (pentafluorophenyl)borate, decamethyl ferrocenium tetrakis (pentafluorophenyl)borate, silver tetrakis (pentafluorophenyl)borate, trityl tetrakis(pentafluorophenyl) borate, lithium tetrakis(pentafluorophenyl)borate, sodium tetrakis(pentafluorophenyl)borate, tetraphenyl porphyrin manganese tetrakis(pentafluorophenyl)borate, silver tetrafluoroborate, silver hexafluorophosphate, silver hexafluoroarsenate, silver perchlorate, silver trifluoroacetate and silver trifluoromethane sulfonate. One of the catalyst components (B-1) may be singularly used or at least two thereof may be used in combination.

Examples of the aluminoxanes of the catalyst component (b-2) include a linear aluminoxane represented by the following formula (10) and a cyclic aluminoxane represented by the following formula (11).

[Formula 7]

(10)

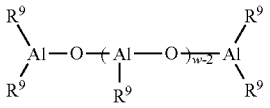

[Formula 8]

(11)

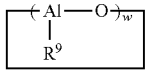

In the formulae (10) and (11), $R^9$ represents a hydrocarbon group having 1 to 20 carbon atoms (preferably 1 to 12 carbon atoms) such as an alkyl group, an alkenyl group, an aryl group and an aryl alkyl group, or a halogen atom. w represents an average polymerization degree of an integer typically of 2 to 50, preferably of 2 to 40. It should be noted that $R^9$ may be the same or different.

A manufacturing method of the above-described aluminoxanes is exemplified by a method of contacting alkyl aluminium with a condensation agent (e.g., water), but the manufacturing method is subject to no specific limitation. The aluminoxanes may be manufactured by reaction according to any known method.

Examples of the method include (1) a method of dissolving an organic aluminium compound in an organic solvent and contacting the obtained solution with water, (2) a method of initially adding an organic aluminium compound at the time of polymerization and later adding water, (3) a method of reacting crystallization water contained in metal salts and the like and adsorption water on an inorganic/organic substance with an organic aluminium compound, and (4) a method of reacting tetraalkyl dialuminoxane with trialkyl aluminium, followed by further reaction with water. It should be noted that the aluminoxanes may be insoluble in toluene. One of the aluminoxanes may be singularly used, or at least two thereof may be used in combination.

When the catalyst component (b-1) is used as the catalyst component (b), a ratio of the catalyst component (a) and the catalyst component (b) in use is preferably in a range of 10:1 to 1:100 in a molar ratio, more preferably in a range of 2:1 to 1:10. When the ratio is out of the range, a catalyst cost per unit mass of polymer is impractically increased. When the catalyst component (b-2) is used as the catalyst component (b), the ratio of the catalyst component (a) and the catalyst component (b) is preferably in a range of 1:1 to 1:1000000 in a molar ratio, more preferably in a range of 1:10 to 1:10000. When the ratio is out of the range, a catalyst cost per unit mass of polymer is impractically increased. Moreover, as the catalyst component (b), one of the compounds of the catalyst component (b-1) and the catalyst component (b-2) may be singularly used, or at least two of the compounds may be used in combination.

In this exemplary embodiment of the invention, a monomer for manufacturing a

PAO by a metallocene catalyst (hereinafter, also referred to as an "mPAO") is preferably an alpha-olefin having 10 to 14 carbon atoms. A linear alpha-olefin is preferable in terms of a viscosity index and low-temperature properties. Examples of the linear alpha-olefin include 1-decene, 1-dodecene and 1-tetradecene, among which 1-decene is particularly preferable.

A blend ratio between the metallocene compound represented by the formula (1) or (4) and the alpha-olefin (the metallocene compound (mmol)/the alpha-olefin (L)) is typically from 0.01 to 0.4, preferably from 0.05 to 0.3, more preferably from 0.1 to 0.2. When the blend ratio is 0.01 or more, a sufficient catalyst activity is obtained. When the blend ratio is 0.4 or less, the yield of the oligomers of a trimer or a multimer suitable to the lubricating base oil is improved and incomplete decalcification of the catalyst is avoided.

Polymerization of the alpha-olefin is preferably performed in the presence of hydrogen. A content of hydrogen is typically in a range of 0.1 kPa to 50 kPa, preferably in a range of 0.5 kPa to 30 kPa, more preferably in a range of 1 kPa to 10 kPa. When the content of hydrogen is 0.1 kPa or more, a sufficient catalyst activity is obtained. When the content of hydrogen is 50 kPa or less, the alpha-olefin (a starting material) can be inhibited from being saturated, thereby improving a yield of the mPAO (a target compound).

A method for polymerization of the alpha-olefin is subject to no limitation. Polymerization may be performed either in the absence of a solvent or in a solvent. When a reaction solvent is used, examples of the reaction solvent include: an aromatic hydrocarbon such as benzene, toluene, xylene and ethyl benzene; an alicyclic hydrocarbon such as cyclopentane, cyclohexane and methylcyclohexane; an aliphatic hydrocarbon such as pentane, hexane, heptane and octane; and a halogenated hydrocarbon such as chloroform and dichloromethane. A temperature for polymerization is typically in a range of 0 degree C. to 100 degrees C., preferably in a range of 20 degrees C. to 80 degrees C., more preferably in a range of 30 degrees C. to 70 degrees C. When the temperature falls within the range, a sufficient catalyst activity is obtained and the yield of the oligomers of a trimer or a multimer suitable to the lubricating base oil is improved. When the polymerization is performed by the above method, the mPAO having 50% or more of a selection ratio of a trimer or a multimer can be manufactured.

Depending on a purpose, the mPAO obtained by the above method may be further processed. For instance, hydrotreatment may be performed for improving thermal stability and oxidization stability. Moreover, distillation may be performed for obtaining a lubricating base oil having desired properties. A hydrotreatment temperature is typically in a range of 50 degrees C. to 300 degrees C., preferably in a range of 60 degrees C. to 250 degrees C., more preferably in a range of 70 degrees C. to 200 degrees C. A hydrogen pressure is typically in a range of 0.1 MPa to 10 MPa, preferably in a range of 0.5 MPa to 2 MPa, more preferably in a range of 0.7 MPa to 1.5 MPa. In the hydrotreatment, a general hydrogenated catalyst including Pd or Ni may be used. A distillation temperature is typically in a range of 200 degrees C. to 300 degrees C., preferably in a range of 220 degrees C. to 280 degrees C., more preferably in a range of 230 degrees C. to 270 degrees C. A distillation pressure is typically in a range of 0.1 Pa to 15 Pa, preferably in a range of 0.4 Pa to 7 Pa, more preferably in a range of 0.6 Pa to 4 Pa.

The mPAO obtained by the above method and the mPAO after the hydrotreatment and distillation have about one short-chain branch per molecule (typically from 0.6 to 1.2 short-chain branches, preferably from 0.7 to 1.1, more preferably from 0.8 to 1.0). It should be noted that a methyl group, an ethyl group and a propyl group are herein referred to as a short-chain branch. In addition, the short-chain branch is primarily a methyl group. A ratio of the methyl group is typically 80 mol % or more, preferably 85 mol % or more, more preferably 90 mol % or more.

In the composition according to this exemplary embodiment of the invention, the content of the component (A) is required to be 10 mass % or more of a total amount of the composition. When the content of the component (A) is less than 10 mass %, the object of the invention cannot be sufficiently achieved. The content of the component (A) is preferably 15 mass % or more, more preferably 20 mass % or more in terms of a low vaporizability. However, the content of the component (A) is preferably 80 mass % or less in terms of solubility of additives and compatibility with seal rubber.

Component (B)

The component (B) according to the exemplary embodiment of the invention is a mineral oil having a viscosity index of 120 or more. Such a mineral oil is preferably, for instance, a hydrorefined mineral oil of Group III in the API classification.

The component (B) blended with the component (A) provides an appropriate lubricity to the composition and contributes to improvement in the fuel-saving performance.

Moreover, blending the component (B) improves solubility of an additive generally used for the internal combustion engine, resulting in a large contribution to the fuel-saving performance.

Accordingly, the component (B) to be blended is preferably 50 mass % or more of the total amount of the composition, more preferably 60 mass % or more.

In the exemplary embodiment of the invention, a kinematic viscosity at 100 degrees C. of a mixed base oil provided by blending the above-described components (A) and (B) is preferably 4.35 $mm^2/s$ or less, more preferably 4.2 $mm^2/s$ or less.

The kinematic viscosity at 100 degrees C. of the mixed base oil of 4.35 $mm^2/s$ or less contributes to improvement in the fuel-saving performance. However, the kinematic viscosity at 100 degrees C. of the mixed base oil is preferably 3 $mm^2/s$ or more in terms of vaporizability.

Although the composition contains the above-described mixed base oil as a main component, it is preferable that the NOACK in the composition is 13 mass % or less and the CCS viscosity at −35 degrees C. is 5500 mPa·s or less. When the NOACK and the CCS viscosity at −35 degrees C. fall within the respective ranges, the composition exhibits a low vaporizability and excellent fluidity at low temperatures (fuel-saving performance), so that the composition is suitable to a lubricating oil for the internal combustion engine.

The lubricating oil composition of the invention may be blended as necessary with other additives such as a viscosity index improver, a pour point depressant, a detergent dispersant, an antioxidant, an antiwear agent or an extreme pressure agent, a friction modifier, a metal deactivator, a rust inhibitor, a surfactant or an anti-emulsifier and antifoaming agent as long as an object of the invention is not hampered.

Examples of the viscosity index improver are polymethacrylate, dispersed polymethacrylate, an olefin-based copolymer (such as an ethylene-propylene copolymer), a dispersed olefin-based copolymer, a styrene-based copolymer (such as a styrene-diene copolymer and a styrene-isoprene copolymer). In terms of blending effects, a content of the viscosity index improver is preferably in a range of 0.5 mass % to 15 mass % of the total amount of the lubricating oil composition, more preferably 1 mass % to 10 mass %.

Examples of the pour point depressant include polymethacrylate having a weight average molecular weight of approximately 5000 to 50,000.

In terms of blending effects, a content of the pour point depressant is preferably in a range of 0.1 mass % to 2 mass % of the total amount of the lubricating oil composition, more preferably 0.1 mass % to 1 mass %.

An ashless dispersant and a metal detergent are usable as the detergent dispersant.

The ashless dispersant may be any ashless dispersant usable in the lubricating oil. Examples of the ashless dispersant include a mono-type succinimide compound represented by the following formula (II) and a bis-type succinimide compound represented by the following formula (III).

[Formula 9]

(II)

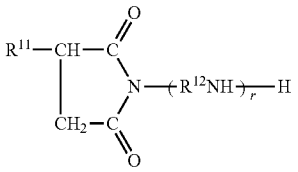

-continued (III)

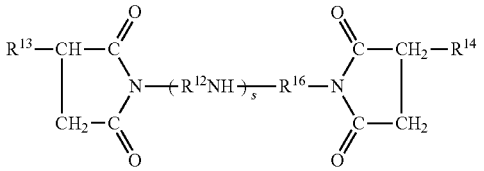

In the formulae (II) and (III), $R^{11}$, $R^{13}$ and $R^{14}$ each are an alkenyl group or an alkyl group having a number average molecular weight of 500 to 4,000, in which $R^{13}$ and $R^{14}$ may be the same or different. The number average molecular weight of each of $R^{11}$, $R^{13}$ and $R^{14}$ is preferably in a range of 1,000 to 4,000. $R^{12}$, $R^{15}$ and $R^{16}$ each are an alkylene group having 2 to 5 carbon atoms, in which $R^{15}$ and $R^{16}$ may be the same or different. r is an integer of 1 to 10. s is 0 or an integer of 1 to 10.

When the number average molecular weight of each of $R^{11}$, $R^{13}$ and $R^{14}$ is less than 500, solubility of the ashless detergent to the base oil is decreased. When the number average molecular weight thereof exceeds 4,000, detergency of the ashless detergent is decreased, so that an intended performance may not be obtained.

r is preferably 2 to 5, more preferably 3 to 4.

When r is less than 1, detergency of the ashless detergent is deteriorated. When r is 11 or more, solubility thereof to the base oil is deteriorated.

In the formula (III), s is preferably 1 to 4, more preferably 2 or 3.

The variables falling within the above range is preferable in terms of detergency and solubility of the ashless detergent to the base oil.

Examples of the alkenyl group include a polybutenyl group, a polyisobutenyl group and an ethylene-propylene copolymer. Examples of the alkyl group include a hydrogenated group of a polybutenyl group, a polyisobutenyl group and an ethylene-propylene copolymer.

Typical example of the suitable alkenyl group is a polybutenyl group or a polyisobutenyl group. The polybutenyl group is obtained by polymerizing a mixture of 1-butene and isobutene, or high-purity isobutene. Typical example of the suitable alkyl group is a hydrogenated group of a polybutenyl group or a polyisobutenyl group.

The alkenyl- or alkyl-succinimide compound may be typically produced by reacting an alkenylsuccinic anhydride, which is obtained by reaction of a polyolefin and maleic anhydride, or an alkylsuccinic anhydride, which is obtained by hydrogenation of the alkenylsuccinic anhydride, with a polyamine.

The mono-type succinimide compound and the bis-type succinimide compound can be produced by changing a reaction ratio between the alkenylsuccinic anhydride or the alkylsuccinic anhydride and the polyamine.

As an olefin monomer for forming the above polyolefin, one of alpha-olefins having 2 to 8 carbon atoms may be singularly used or at least two thereof may be used in a mixture. A mixture of isobutene and butene-1 is suitably usable.

Examples of the polyamine include: a diamine such as ethylenediamine, propylenediamine, butylenediamine and pentylenediamine; a polyalkylenepolyamine such as diethylenetriamine, triethylenetetramine, tetraethylenepentamine, pentaethylenehexamine, di(methylethylene)triamine, dibutylenetriamine, tributylenetetramine and pentapentylenehexamine; and a piperadine derivative such as aminoethylpiperadine.

In addition to the above-mentioned alkenyl- or alkyl-succinimide compound, at least one of a boron derivate thereof and an organic acid-modified compound thereof may be used.

The boron derivate of the alkenyl- or alkyl-succinimide compound which is produced by a conventional method may be employed.

For instance, the above polyolefin is reacted with maleic anhydride to form an alkenylsuccinic anhydride. The alkenylsuccinic anhydride is imidized with an intermediate body, which is obtained by reaction of the above polyamine with a boron compound such as boron oxide, boron halide, boric acid, boric anhydride, boric acid ester or ammonium borate, thereby obtaining the boron derivative.

A boron content of the boron derivate is subject to no specific limitation, but is preferably in a range of 0.05 mass % to 5 mass %, more preferably in a range of 0.1 mass % to 3 mass %.

A content of the mono-type succinimide compound represented by the formula (II) or the bis-type succinimide compound represented by the formula (III) is preferably in a range of 0.5 mass % to 15 mass % of the total amount of the lubricating oil composition, more preferably 1 mass % to 10 mass %.

At the content of less than 0.5 mass %, the mono-type succinimide compound or the bis-type succinimide compound are less likely to exhibit the advantages. Even when the content exceeds 15 mass %, advantages comparable to the content are not obtained.

As long as the succinimide compounds are contained at the aforementioned content, one of the succinimide compounds may be singularly used or at least two thereof may be used in combination.

The metal-based detergent may be any alkyl earth metal-based detergent usable in the lubricating oil. For example, any one of alkaline earth metal sulfonate, alkaline earth metal phenate and alkaline earth metal salicylate and a mixture of at least two selected therefrom are usable.

Examples of the alkaline earth metal sulfonate include an alkaline earth metal salt of alkyl aromatic sulfonic acid obtained by sulfonating an alkyl aromatic compound having a molecular weight of 300 to 1500 (preferably 400 to 700). The alkaline earth metal salt is exemplified by magnesium salt and/or calcium salt. Particularly, calcium salt is preferably used.

Examples of the alkaline earth metal phenate include an alkaline earth metal salt of alkylphenol, alkylphenol sulfide and a Mannich reaction product of alkylphenol. The alkaline earth metal salt is exemplified by magnesium salt and/or calcium salt, among which calcium salt is preferably used.

Examples of the alkaline earth metal salicylate include an alkaline earth metal salt of alkyl salicylic acid, which is exemplified by magnesium salt and/or calcium salt, among which calcium salt is preferably used.

The alkyl group for forming the alkaline earth metal detergent preferably has 4 to 30 carbon atoms. The alkyl group is more preferably a linear or branched alkyl group having 6 to 18 carbon atoms, in which 6 to 18 carbon atoms may be in a linear chain or in a branched chain.

The alkyl group may be a primary alkyl group, a secondary alkyl group or a tertiary alkyl group.

In addition, the alkaline earth metal sulfonate, alkaline earth metal phenate and alkaline earth metal salicylate may be neutral alkaline earth metal sulfonate, neutral alkaline earth metal phenate and neutral alkaline earth metal salicylate obtained by: directly reacting the above-described alkyl aromatic sulfonic acid, alkylphenol, alkylphenol sulfide, a Mannich reaction product of alkylphenol, alkyl salicylic acid or the like with alkaline earth metal base exemplified by an oxide or a hydroxide of alkaline earth metal such as magnesium and/or calcium; or converting the above-described substance into alkali metal salt such as sodium salt or potassium salt and subsequently substituting the alkali metal salt with alkaline earth metal salt. Alternatively, the alkaline earth metal sulfonate, alkaline earth metal phenate and alkaline earth metal salicylate may be: basic alkaline earth metal sulfonate, basic alkaline earth metal phenate and basic alkaline earth metal salicylate obtained by heating neutral alkaline earth metal sulfonate, neutral alkaline earth metal phenate and neutral alkaline earth metal salicylate with excess alkaline earth metal salt or alkaline earth metal base under the presence of water; or overbased alkaline earth metal sulfonate, overbased alkaline earth metal phenate and overbased alkaline earth metal salicylate obtained by reacting neutral alkaline earth metal sulfonate, neutral alkaline earth metal phenate and neutral alkaline earth metal salicylate with carbonate or borate of alkaline earth metal under the presence of carbon dioxide gas.

The metal detergent may be the neutral salt, the basic salt, the overbased salt or a mixture thereof. Particularly, a mixture of at least one of the overbased salicylate, the overbased phenate and the overbased sulfonate with the neutral sulfonate is preferable in terms of detergency and wear resistance.

A total base number of the metal detergent is preferably in a range of 10 mgKOH/g to 500 mgKOH/g, more preferably in a range of 15 mgKOH/g to 450 mgKOH/g.

The total base number herein means the total base number measured by potentiometer titration (base number·perchloric acid method) based on the Item 7 of "Petroleum Products and Lubricating Oil—Examining Method of Neutralization Value" of JIS K2501.

The metal detergent, of which metal ratio is subject to no particular limitation, is typically one of or a mixture of at least two of detergents having the metal ratio of 20 or less. In terms of excellent oxidation stability, base number maintainability and high-temperature detergency, the metal detergent particularly preferably contains as the main component a metal detergent that has the metal ratio of 3 or less, more preferably 1.5 or less, particularly preferably 1.2 or less.

The metal ratio herein is represented by (valence of metal element in the metal detergent)×(content of metal element (mol %))/(content of soap base (mol %)), and the metal element means calcium, magnesium and the like while the soap base means a sulfonate group, phenol group, salicylic acid group and the like.

The metal detergent, which is commercially available in a form of a dilution with light lubricant base oil and the like, preferably has a metal content of 1 to 20 mass %, more preferably 2 to 16 mass %.

A content of the metal detergent is preferably in a range of 0.01 mass % to 20 mass % of the total amount of the lubricating oil composition, more preferably 0.1 mass % to 10 mass %.

At the content of less than 0.01 mass %, the metal detergent are less likely to exhibit the advantages. Even when the content exceeds 20 mass %, advantages comparable to the added content are not obtained.

As long as the metal detergent is contained at the aforementioned content, one of the metal detergents may be singularly used or at least two thereof may be used in combination.

The antioxidant may be exemplified by a phenolic antioxidant, an amine antioxidant, a molybdenum-amine complex-based antioxidant and a sulfuric antioxidant.

Examples of the phenolic antioxidant include: 4,4'-methylenebis(2,6-di-t-butylphenol); 4,4'-bis(2,6-di-t-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butylphenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-di-t-butyl-4-ethylphenol; 2,4-dimethyl-6-t-butylphenol; 2,6-di-t-amyl-p-cresol; 2,6-di-t-butyl-4-(N, N'-dimethylaminomethylphenol); 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl)sulfide; bis(3,5-di-t-butyl-4-hydroxybenzyl) sulfide; n-octyl-3-(4-hydroxy-3,5-di-t-butylphenyl) propionate; n-octadecyl-3-(4-hydroxy-3,5-di-t-butylphenyl) propionate; and 2,2'-thio [diethyl-bis-3-(3,5-di-t-butyl-4-hydroxyphenyl)propionate].

A bisphenolic antioxidant and an ester group-containing phenolic antioxidant are particularly preferable among the above.

Examples of the amine antioxidant include an antioxidant based on monoalkyldiphenylamine such as monooctyldiphenylamine and monononyldiphenylamine; dialkyl diphenylamine such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine such as tetrabutyldiphenylamine, tetrahexyldiphenylamine, tetraoctyldiphenylamine and tetranonyldiphenylamine; and naphthylamine, specifically alpha-naphthylamine, phenyl-alpha-naphthylamine and alkyl-substituted phenyl-alpha-naphthylamine such as butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine and nonylphenyl-alpha-naphthylamine.

A dialkyl diphenylamine antioxidant and a naphthylamine antioxidant are preferable among the above.

As the molybdenum-amine complex-based antioxidant, a hexahydric molybdenum compound, an example of which is a reaction product obtained by reacting molybdenum trioxide and/or molybdenum acid with an amine compound, may be used. The reaction product may be, for example, a compound obtained by the manufacturing method disclosed in JP-A-2003-252887.

The anime compound to be reacted with the hexahydric molybdenum compound is subject to no particular limitation, and examples thereof are monoamine, diamine, polyamine and alkanolamine.

Specific examples of the amine compound are: alkyl amine having an alkyl group of 1 to 30 carbon atoms (the alkyl group may contain a linear chain or a branched chain), exemplified by methylamine, ethylamine, dimethylamine, diethylamine, methylethylamine, methylpropylamine and the like; alkenyl amine having an alkenyl group of 2 to 30 carbon atoms (the alkenyl group may contain a linear chain or a branched chain), exemplified by ethenylamine, propenylamine, butenylamine, octenylamine and oleylamine; alkanol amine having an alkanol group of 1 to 30 carbon atoms (the alkanol group may contain a linear chain or a branched chain), exemplified by methanolamine, ethanolamine, methanolethanolamine and methanolpropanolamine; alkylenediamine having an alkylene group of 1 to 30 carbon atoms, exemplified by methylenediamine, ethylenediamine, propylenediamine and butylenediamine; polyamine such as diethylenetriamine, triethylenetetramine, tetraethylenepentamine and pentaethylenehexamine; a heterocyclic compound obtained by reacting monoamine, diamine and polyamine with a compound having an alkyl or alkenyl group of 8 to 20 carbon atoms or imidazoline, monoamine, diamine and polyamine being exemplified by undecyldiethylamine, undecyldiethanolamine, dodecyldipropanolamine, oleyldiethanolamine, oleylpropylenediamine and stearyltetraethylenepentamine; an alkylene-oxide adduct of the compounds; and a mixture thereof.

In addition, sulfur-containing molybdenum complexes of succinimide as disclosed in JP-B-03-22438 and JP-A-2004-2866 may be used.

Examples of the sulfuric antioxidant include phenothiazine, pentaerythritol-tetrakis-(3-laurylthiopropionate), didodecyl sulfide, dioctadecyl sulfide, didodecyl thiodipropionate, dioctadecyl thiodipropionate, dimyristyl thiodipropionate, dodecyloctadecyl thiodipropionate and 2-mercaptobenzoimidazole.

A content of the antioxidant is preferably in a range of 0.1 mass % to 5 mass % of the total amount of the lubricating oil composition, more preferably 0.1 mass % to 3 mass %.

Examples of the antiwear agent or the extreme pressure agent include: sulfur-containing compounds such as zinc dithiophosphate, zinc phosphate, zinc dithiocarbamate, disulfides, sulfurized olefins, sulfurized fats and oils, sulfurized esters, thiocarbonates, thiocarbamates and polysulfides; phosphorus-containing compounds such as phosphite esters, phosphate esters, phosphonate esters and amine salts or metal salts thereof; and a sulfur-and-phosphorus-containing antiwear agent such as thiophosphite esters, thiophosphate esters, thiophosphonate esters and amine salts or metal salts thereof.

A content of the antiwear agent or the extreme pressure agent is preferably in the range from 0.1 mass % to 20 mass % of the total amount of the composition.

When the antiwear agent or the extreme pressure agent is a zinc-containing compound, the antiwear agent or the extreme pressure agent is preferably 600 mass ppm or less in terms of zinc (of the total amount of the composition), more preferably 500 mass ppm or less, further preferably 400 mass ppm or less. When the antiwear agent or the extreme pressure agent is a phosphorus-containing compound, the antiwear agent or the extreme pressure agent is preferably 500 mass ppm or less in terms of phosphorus (of the total amount of the composition), more preferably 400 mass ppm or less, further preferably 300 mass ppm or less. When the zinc content is 600 mass ppm or less or the phosphorus content is 500 mass ppm or less, the composition does not cause a basic compound to be consumed to extremely shorten an oil replacement interval.

As the friction modifier, any compounds generally usable as the friction modifier for lubricating oil may be used. The friction modifier is exemplified by an ashless friction modifier such as an aliphatic ester, an aliphatic amide, a fatty acid, aliphatic alcohol, an aliphatic amine and an aliphatic ether that have at least one alkyl or alkenyl group having 6 to 30 carbon atoms in the molecule.

A content of the friction modifier is preferably in a range of 0.01 mass % to 2 mass % of the total amount of the lubricating oil composition, more preferably 0.01 mass % to 1 mass %.

Examples of the metal deactivator include benzotriazole-based compounds, tolyltriazole-based compounds, thiadiazole-based compounds, imidazole-based compounds and the like.

A content of the metal deactivator is preferably in a range of 0.01 mass % to 3 mass % of the total amount of the lubricating oil composition, more preferably 0.01 mass % to 1 mass %.

Examples of the rust inhibitor include petroleum sulfonate, alkylbenzene sulfonate, dinonylnaphthalene sulfonate, alkenyl succinic ester, multivalent alcohol ester and the like.

In terms of blending effects, a content of the rust inhibitor is preferably in a range of 0.01 mass % to 1 mass % of the total amount of the lubricating oil composition, more preferably 0.05 mass % to 0.5 mass %.

Examples of the surfactant or the anti-emulsifier include nonionic surfactants based on polyalkylene glycol such as polyoxyethylenealkylether, polyoxyethylenealkylphenylether and polyoxyethylenealkylnaphthylether.

A content of the metal deactivator or the anti-emulsifier is preferably in a range of 0.01 mass % to 3 mass % of the total amount of the lubricating oil composition, more preferably 0.01 mass % to 1 mass %.

Examples of the antifoaming agent include silicone oil, fluorosilicone oil and fluoroalkylether. In terms of a balance between antifoaming effects and economics, a content of the antifoaming agent is preferably in a range of 0.005 mass % to 0.5 mass % of the total amount of the compound, more preferably in a range of 0.01 mass % to 0.2 mass %.

EXAMPLES

Examples of the invention will be described below in detail. However, it should be noted that the scope of the invention is by no means limited by the examples.

Properties and practical performances (motoring performance) of a lubricating oil composition (sample oil) in each Example were measured by the following method.

(1) Kinematic Viscosity at 100 Degrees C.

The kinematic viscosity at 100 degrees C. was measured according to a method described in JIS K2283. The kinematic viscosity at 100 degrees C. of the mixed base oil was also measured.

(2) NOACK

Evaporation loss was measured according to ASTM D 5800-08.

(3) CCS Viscosity (Cold-Cranking Simulator Viscosity)

A shear viscosity at −35 degrees was measured according to JIS K2010.

(4) Viscosity Index:

The viscosity index was calculated according to a method described in JIS K2283.

(5) Motoring Performance

The following motoring test was performed.

Using a 1500-cc in-line four cylinder DOHC engine, a driving torque was measured in a combination of an oil temperature (60 degrees C., 80 degrees C., 100 degrees C.) and a rotation speed (1500 rpm, 2000 rpm, 2500 rpm). An average of all nine data was defined as a driving torque value of the sample oil. Using commercially available ACEA C2 5W-30 (a kinematic viscosity at 100 degrees C.: 10.29 $mm^2/s$, NOACK: 14.3 mass %, CCS viscosity (−35 degrees C.): 7700 mPa·s, a viscosity index: 172) as a reference oil, the driving torque value of the sample oil relative to a driving torque value of the reference oil was defined as a torque improvement rate. A motoring performance of the sample oil was evaluated based on the following scale.

A: more excellent than the reference oil (the torque improvement rate relative to the reference oil: 1.5% or more)

B: more excellent than the reference oil (the torque improvement rate relative to the reference oil: less than 1.5%)

C: inferior to the reference oil

A later-described mPAO among the base oil was manufactured by the following method.

Manufacturing Example

Manufacturing of Hydrogenated 1-Decene Oligomer (Trimer)

(a) Oligomerization of Decene

Under a flow of inert gas, 4 liter (21.4 mol) of a decene monomer (manufactured by Idemitsu Kosan Co., Ltd: LINEALENE 10) was put into a three-necked flask having an inner volume of 5 liter and biscyclopentadienyl zirconium dichloride (a complex mass: 1168 mg (4 mmol)) that was dissolved in toluene and methyl alumoxane (40 mmol in terms of Al) that was also dissolved in toluene were further added thereto. The obtained mixture was stirred for 20 hours while being kept at 40 degrees C. Subsequently, 20 ml of methanol was added to the mixture to stop the oligomerization reaction. Next, the reaction mixture was taken out of an autoclave and 4 liter of an aqueous sodium hydroxide solution (5 mol/liter) was added to the reaction mixture. The obtained mixture was forcibly stirred for 4 hours at the room temperature and was separated. An organic phase (an upper phase) was taken out. Unreacted decene and a decene isomer of a side reaction product were removed from the organic phase by stripping.

(b) Hydrogenation of Decene Oligomer

Under a flow of nitrogen gas, 3 liter of the decene oligomer manufactured in the step (a) was put into an autoclave having an inner volume of 5 liter and cobalt trisacetylacetonato (a catalyst weight: 3.0 g) that was dissolved in toluene and triisobutyl aluminium (30 mmol) that was diluted in toluene were added thereto. After addition, the obtained mixture was substituted twice by hydrogen and heated to be kept at a reaction temperature of 80 degrees C. and at 0.9 MPa of a hydrogen pressure. Hydrogenation immediately proceeds along with heat generation. When 4 hours elapsed since the reaction was started, the temperature of the mixture was decreased to stop the reaction. Subsequently, after the autoclave was depressurized and contents in the autoclave were taken out, a simple distillation was performed on the obtained reaction product, so that a fraction (hydrogenated trimer of 1-decene) under pressure of 530 Pa was separated at a distillation temperature in a range of 240 degrees C. to 270 degrees C.

Examples 1 to 3 and Comparatives 1 to 4

Lubricating oil compositions (the sample oils) having compositions as shown in Table 1 were prepared using the following PAOs, mineral oils and additives. Properties and various performances of the sample oils are shown in Table 1.

PAO-1: Durasyn 125 manufactured by INEOS Group Limited (a kinematic viscosity at 100 degrees C.: 5.196 $mm^2/s$, NOACK: 5.5 mass %, a CCS viscosity (−35 degrees C.): 2490 mPa·s, a viscosity index: 143)

PAO-2: Durasyn 145 manufactured by INEOS Group Limited (a kinematic viscosity at 100 degrees C.: 5.194 $mm^2/s$, NOACK: 5.1 mass %, a CCS viscosity (−35 degrees C.): 2570 mPa·s, a viscosity index: 145)

PAO-3: the mPAO obtained in the above Manufacturing Example (a kinematic viscosity at 100 degrees C.: 3.458 $mm^2/s$, NOACK: 11.1 mass %, a CCS viscosity (−35 degrees C.): 800 mPa·s, a viscosity index: 127)

PAO-4: Durasyn 164 manufactured by INEOS Group Limited (a kinematic viscosity at 100 degrees C.: 3.893 $mm^2/s$, NOACK: 14.0 mass %, a CCS viscosity (−35 degrees C.): 1330 mPa·s, a viscosity index: 120)

PAO-5: Durasyn 166 manufactured by INEOS Group Limited (a kinematic viscosity at 100 degrees C.: 5.824 $mm^2/s$, NOACK: 6.0 mass %, a CCS viscosity (−35 degrees C.): 3950 mPa·s, a viscosity index: 178)

Mineral Oil-1: hydrorefined mineral oil (a kinematic viscosity at 100 degrees C.: 4.121 $mm^2/s$, NOACK: 14.1 mass %, a CCS viscosity (−35 degrees C.): 1870 mPa·s, a viscosity index: 122)

Mineral Oil-2: hydrorefined mineral oil (a kinematic viscosity at 100 degrees C.: 6.483 $mm^2/s$, NOACK: 7.5 mass %, a CCS viscosity (−35 degrees C.): 10100 mPa·s, a viscosity index: 121)

Additive Package: Infineum P6000 Manufactured by Infineum

Viscosity Index Improver: polymethacrylate (a mass average molecular weight of 230,000, a resin portion of 45 mass % (The blended content shown in Table 1 is a total amount of the viscosity index improver including the resin portion.))

Pour Point Depressant: polyalkylmethacrylate (a mass average molecular weight of 6,000)

TABLE 1

| | | | Example 1 | Example 2 | Example 3 | Comparative 1 | Comparative 2 | Comparative 3 | Comparative 4 |
|---|---|---|---|---|---|---|---|---|---|
| Blend Composition (mass %) | Base Oil | PAO-1: Component (A) | 15.0 | — | — | — | — | — | — |
| | | PAO-2: Component (A) | — | 15.0 | — | — | — | — | — |
| | | PAO-3: Component (A) | — | — | 15.0 | — | — | — | — |
| | | PAO-4 | — | — | — | — | — | 13.0 | — |
| | | PAO-5 | — | — | — | 15.0 | 25.0 | 10.0 | — |
| | | Mineral Oil-1: Component (B) | 65.8 | 65.8 | 65.8 | 65.8 | 55.8 | 57.8 | 70.8 |
| | | Mineral Oil-2: Component (B) | — | — | — | — | — | — | 10.0 |
| | Additive | Additive Package | 12.0 | 12.0 | 12.0 | 12.0 | 12.0 | 12.0 | 12.0 |
| | | Viscosity Index Improver | 7.0 | 7.0 | 7.0 | 7.0 | 7.0 | 7.0 | 7.0 |
| | | Pour Point Depressant | 0.2 | 0.2 | 0.2 | 0.2 | 0.2 | 0.2 | 0.2 |
| Kinematic Vicosity at 100° C. of Mixed Base Oil ($mm^2/s$) | | | 4.296 | 4.296 | 3.984 | 4.379 | 4.564 | 4.250 | 4.337 |
| Properties of Sample Oil | | NOACK (mass %) | 11.3 | 11.3 | 12.2 | 11.4 | 10.6 | 11.9 | 12.0 |
| | | CCS Viscosity (−35° C., mPa · s) | 5250 | 5200 | 4300 | 6050 | 6350 | 5550 | 6550 |
| Motoring test results | | | B | B | A | B | C | B | B |

Evaluation Results

Since the sample oils of Examples 1 to 3, which are configured to match the composition of the invention, contain the PAO having specific properties and the mineral oil having specific properties as shown in Table 1, it can be understood that the sample oils exhibit a low vaporizability and an excellent fuel-saving performance. Moreover, the sample oils also exhibit an excellent fluidity at low temperatures. The excellent fuel-saving performance is also apparent from the results of the motoring test. Accordingly, the composition of the invention is suitable not only to a typical internal combustion engine but also a gasoline engine and a diesel engine which are provided with a turbo mechanism.

In contrast, since none of the sample oils of Comparatives contain a predetermined PAO, a low vaporizability and fuel-saving performance cannot be simultaneously satisfied.

The invention claimed is:

1. A lubricating oil composition for an internal combustion engine, comprising:

a component (A) of a polyalphaolefin having a kinematic viscosity at 100 degrees C. of 5.5 $mm^2/s$ or less, a CCS viscosity at −35 degrees C. of 3000 mPa·s or less and a NOACK of 12 mass % or less; and a component (B) of a mineral oil having a viscosity index of 120 or more, wherein the component (A) is present in the composition in an amount of 10 mass % or more relative to the total amount of the composition;

wherein the component (A) is provided by polymerization with a metallocene catalyst.

2. The lubricating oil composition according to claim 1, wherein a mixed base oil provided by blending the components (A) and (B) has a kinematic viscosity at 100 degrees C. of 4.35 $mm^2/s$ or less.

3. The lubricating oil composition according to claim 1, wherein the NOACK of the composition is 13 mass % or less and the CCS viscosity at −35 degrees C. is 5500 mPa·s or less.

4. The lubricating oil composition according to claim 1, wherein the component (B) is present in the composition in an amount of 50 mass % or more relative to the total amount of the composition.

5. The lubricating oil composition according to 1, wherein the component (A) is a polyalphaolefin formed by polymerizing at least one alpha-olefin having 10 to 14 carbon atoms as a monomer unit.

6. The lubricating oil composition according to claim 1, wherein the component (A) is a trimer.

7. The lubricating oil composition according to claim 2, wherein the NOACK of the composition is 13 mass % or less and the CCS viscosity at −35 degrees C. is 5500 mPa·s or less.

8. A method for lubricating an internal combustion engine comprising contacting said engine with the lubricating oil composition for an internal combustion engine according to claim 1.

9. The method of claim 8, wherein the engine is a gasoline engine.

10. The method of claim 8, wherein the engine is a diesel engine.

* * * * *